US008033634B2

(12) United States Patent
Komatsu et al.

(10) Patent No.: US 8,033,634 B2
(45) Date of Patent: Oct. 11, 2011

(54) LIQUID DISCHARGING APPARATUS, METHOD OF CONTROLLING THE SAME, AND PROGRAM THAT IMPLEMENTS THE METHOD

(75) Inventors: Shinya Komatsu, Shiojiri (JP); Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 243 days.

(21) Appl. No.: 12/234,090

(22) Filed: Sep. 19, 2008

(65) Prior Publication Data

US 2009/0073208 A1 Mar. 19, 2009

(30) Foreign Application Priority Data

Sep. 19, 2007 (JP) ..... 2007-242724

(51) Int. Cl.
*B41J 29/393* (2006.01)

(52) U.S. Cl. ..... 347/19; 347/14

(58) Field of Classification Search ..... 347/19, 347/5, 9, 10
See application file for complete search history.

(56) References Cited

U.S. PATENT DOCUMENTS 3,977,010 A * 8/1976 Erickson et al. ..... 347/81
4,012,745 A * 3/1977 Brown et al. ..... 347/80
4,333,083 A * 6/1982 Aldridge ..... 347/81
4,373,164 A * 2/1983 Osaki et al. ..... 347/81
4,591,874 A * 5/1986 Piatt ..... 347/78
6,164,746 A * 12/2000 Akahira et al. ..... 347/15
7,121,642 B2 * 10/2006 Stoessel et al. ..... 347/19
2003/0081040 A1 * 5/2003 Therien et al. ..... 347/19
2004/0023567 A1 * 2/2004 Koyama et al. ..... 439/894
2004/0027405 A1 * 2/2004 Stoessel et al. ..... 347/19
2004/0095410 A1 * 5/2004 Miyashita ..... 347/19
2005/0007404 A1 * 1/2005 Usui ..... 347/14
2005/0083364 A1 * 4/2005 Billow ..... 347/19
2005/0248606 A1 * 11/2005 Hoshiyama et al. ..... 347/19
2006/0101926 A1 * 5/2006 Komatsu et al. ..... 73/865.9
2006/0125868 A1 * 6/2006 Komatsu et al. ..... 347/19
2007/0052745 A1 * 3/2007 Izuo ..... 347/14

FOREIGN PATENT DOCUMENTS

JP 62116259 A * 5/1987
JP 2004361234 A * 12/2004
JP 2006130869 A * 5/2006
JP 2007-118571 5/2007

* cited by examiner

*Primary Examiner* — Charlie Peng
*Assistant Examiner* — Peter Radkowski
(74) *Attorney, Agent, or Firm* — Workman Nydegger

(57) ABSTRACT

A liquid discharging apparatus includes a discharging device, a liquid receiving device, a voltage applying device, and a control device. The discharging discharges liquid from a nozzle to a target on the basis of discharge data, where it is received by a liquid receiving device. The voltage applying device applies a predetermined voltage between the discharging device and the liquid receiving device. When discharging on the basis of the discharge data, the control device controls the discharging device to discharge using a generated discharge data driving signal. When performing nozzle testing, the control device controls the voltage applying device to apply the predetermined voltage between the discharging device and the liquid receiving device and controls the discharging device using a generated test driving signal to discharge liquid from the nozzle to determine on the basis of a detected electrical change whether liquid is discharged from the nozzle.

8 Claims, 8 Drawing Sheets

LIQUID DISCHARGING APPARATUS, METHOD OF CONTROLLING THE SAME, AND PROGRAM THAT IMPLEMENTS THE METHOD

BACKGROUND

1. Technical Field

The invention relates to a liquid discharging apparatus and a method of controlling the same.

2. Related Art

In an existing art, an ink jet printer is proposed as a liquid discharging apparatus, in which a voltage change that occurs when electrically charged ink droplets are discharged from nozzles of the print head to an ink receiving area is detected by a voltage detection circuit to perform head testing as to whether ink is normally discharged from the nozzles, which is, for example, described in JP-A-2007-118571. The ink jet printer described in JP-A-2007-118571 discharges a plurality of ink droplets from a nozzle to thereby obtain a sufficiently large output waveform at the time of head testing.

The ink jet printer described in JP-A-2007-118571 is able to obtain a sufficiently large output waveform at the time of head testing, for example, by discharging a plurality of ink droplets; however, this may not be effectively obtaining a detection signal.

SUMMARY

An advantage of some aspects of the invention is that it provides a liquid discharging apparatus that is able to effectively obtain a further large detection signal at the time of testing as to whether liquid is able to be discharged from a nozzle, and a method of controlling the liquid discharging apparatus.

An aspect of the invention is provided in the following manner.

An aspect of the invention provides a liquid discharging apparatus. The liquid discharging apparatus includes a discharging device, a liquid receiving device, a voltage applying device, an electrical change detection device, a driving signal generating device, and a control device. The discharging device is able to discharge liquid from a nozzle to a target on the basis of discharge data. The liquid receiving device receives liquid discharged from the nozzle. The voltage applying device applies a predetermined voltage between the discharging device and the liquid receiving device. The electrical change detection device detects at least one of an electrical change in the discharging device and an electrical change in the liquid receiving device. The driving signal generating device, at the time of discharging on the basis of the discharge data, generates a discharge data driving signal, which is a driving signal for the discharging device and which provides a predetermined interval between a plurality of reference driving waveforms, and, at the time of predetermined nozzle testing, generates a test driving signal, which is a driving signal for the discharging device and in which one or more intervals between the plurality of reference driving waveforms are set to be shorter than the predetermined interval. At the time of discharging on the basis of the discharge data, the control device controls the discharging device so as to perform discharging on the basis of the discharge data using the generated discharge data driving signal, whereas, at the time of the nozzle testing, the control device controls the voltage applying device so as to apply the predetermined voltage between the discharging device and the liquid receiving device and controls the discharging device using the generated test driving signal so as to discharge a plurality of droplets of the liquid from the nozzle to determine on the basis of the detected electrical change whether liquid is discharged from the nozzle to thereby perform the nozzle testing.

The above liquid discharging apparatus, at the time of discharging on the basis of discharge data, generates a discharge data driving signal, which is a driving signal for the discharging device and which provides a predetermined interval between a plurality of reference driving waveforms, and, at the time of predetermined nozzle testing, generates a test driving signal, which is a driving signal for the discharging device and in which one or more intervals between the plurality of reference driving waveforms are set to be shorter than a predetermined interval. Then, at the time of discharging on the basis of discharge data, the discharging is performed using the generated discharge data driving signal, whereas, at the time of nozzle testing, nozzle testing is performed using the generated test driving signal to determine whether liquid is discharged from the nozzle. In this way, at the time of nozzle testing, one or more intervals between a plurality of reference driving waveforms are set to be shorter than the interval of the discharge data driving signal to thereby increase the number of droplets of liquid that can be detected per unit time, so that an electrical change detected per unit time is increased as compared with the case in which testing is performed using the same driving signal as that at the time of discharging on the basis of discharge data. Hence, it is possible to effectively obtain a further large detection signal when it is tested whether liquid is discharged from the nozzle. Here, the "predetermined interval" may be set on the basis of a period of time required for discharging liquid once or may be set on the basis of a print resolution. In addition, the "predetermined voltage" may be empirically determined from the range of an electrical change, which may be detected by the electrical change detection device.

In the liquid discharging apparatus according to the aspect of the invention, the driving signal generating device may generate, as the discharge data driving signal, a signal that includes a plurality of reference driving waveform groups, each of which includes a predetermined number of the reference driving waveforms, and may generate, as the test driving signal, a signal that includes a plurality of reference driving waveform groups, each of which includes the predetermined number of the reference driving waveforms and in which one or more intervals between the plurality of reference driving waveform groups are set to be shorter than the predetermined interval in such a manner that an interval between the reference driving waveform groups is set to be shorter than that of the discharge data driving signal. In this manner, at the time of nozzle testing, by shortening the interval between the reference driving waveform groups, it is possible to increase an electrical change detected per unit time as compared with the case in which testing is performed using the same driving signal as that at the time of discharging on the basis of discharge data. Here, the "predetermined number" may be set in advance by means of a discharge control manner for the liquid discharging apparatus and, for example, may be set to three or four. Then, the liquid discharging apparatus according to the aspect of the invention may include a transport device that reciprocally moves the discharging device at the time of discharging on the basis of the discharge data, wherein the driving signal generating device may generate, as the discharge data driving signal, a signal that includes a temporal margin required for positioning the transport device in an interval between the reference driving waveform groups, and may generate, as the test driving signal, a signal that shortens the interval between the reference driving waveform groups without including the margin as compared with that of the discharge data driving signal. In this way, at the time of nozzle testing, by generating a test driving signal that does not include an unnecessary temporal margin, it is possible to increase an electrical change detected per unit time as compared with the case in which testing is performed using the same driving signal as that at the time of discharging on the basis of discharge data.

In the liquid discharging apparatus according to the aspect of the invention, the driving signal generating device may generate, as the discharge data driving signal, a signal that includes a micro-oscillation waveform between a plurality of the reference driving waveforms used for discharging liquid, and may generate, as the test driving signal, a signal in which one or more of the micro-oscillation waveforms are omitted from the discharge data driving signal to shorten an interval between the one or more reference driving waveforms as compared with the predetermined interval. In this way, at the time of nozzle testing, the test driving signal is generated so that the number of micro-oscillation waveforms that cause a little influence even when a portion of them are omitted from the discharge data driving signal is reduced, and the interval of each two reference driving waveforms that have placed the reduced micro-oscillation waveform is shortened as compared with the interval of other reference driving waveforms. Thus, it is possible to increase an electrical change detected per unit time as compared with the case in which testing is performed using the same driving signal as that at the time of discharging on the basis of discharge data. Here, the "micro-oscillation waveform" may be a waveform that is not used for discharging liquid. At this time, the waveform that is not used for discharging liquid may include a solidification prevention waveform that is used for preventing solidification of liquid in a nozzle. Alternatively, the driving signal generating device may generate, as the discharge data driving signal, a signal that includes a micro-oscillation waveform between a plurality of the reference driving waveforms used for discharging liquid, and may generate, as the test driving signal, a signal in which one or more micro-oscillation waveforms shorter than that of the discharge data driving signal are included to thereby shorten an interval between the one or more reference driving waveforms as compared with the predetermined interval. In this way, at the time of nozzle testing, the test driving signal is generated so that each micro-oscillation waveform of the discharge data driving signal, which causes little influence even when it is shortened, and the interval of two reference driving waveforms that places the shortened micro-oscillation waveform in between is set to be shorter than the interval of other reference driving waveforms. Thus, it is possible to increase an electrical change detected per unit time as compared with the case in which testing is performed using the same driving signal as that at the time of discharging on the basis of discharge data.

Another aspect of the invention provides a method of controlling a liquid discharging apparatus, that includes a discharging device that is able to discharge liquid from a nozzle to a target and a liquid receiving device that receives liquid discharged from the nozzle. The method includes: at the time of discharging on the basis of discharge data, generating a discharge data driving signal, which is a driving signal for the discharging device and which provides a predetermined interval between a plurality of reference driving waveforms; at the time of predetermined nozzle testing, generating a test driving signal, which is a driving signal for the discharging device and in which one or more intervals between the plurality of reference driving waveforms are set to be shorter than the predetermined interval; at the time of discharging on the basis of the discharge data, controlling the discharging device so as to perform the discharging using the generated discharge data driving signal; and, at the time of the nozzle testing, applying a predetermined voltage between the discharging device and the liquid receiving device and controlling the discharging device using the generated test driving signal so as to discharge a plurality of droplets of the liquid from the nozzle to determine on the basis of at least one of an electrical change in the discharging device and an electrical change in the liquid receiving device whether liquid is discharged from the nozzle to thereby perform the nozzle testing.

The above method, at the time of discharging on the basis of discharge data, generates a discharge data driving signal, which is a driving signal for the discharging device and which provides a predetermined interval between a plurality of reference driving waveforms, and, at the time of predetermined nozzle testing, generates a test driving signal, which is a driving signal for the discharging device and in which one or more intervals between a plurality of reference driving waveforms are set to be shorter than a predetermined interval. Then, at the time of discharging on the basis of discharge data, discharging is performed using the generated discharge data driving signal, whereas, at the time of nozzle testing, nozzle testing is performed using the generated test driving signal to determine whether liquid is discharged from the nozzle. In this way, at the time of nozzle testing, one or more intervals between a plurality of reference driving waveforms are set to be shorter than the interval of the discharge data driving signal to thereby increase the number of droplets of liquid that can be detected per unit time, so that an electrical change detected per unit time is increased as compared with the case in which testing is performed using the same driving signal as that at the time of discharging on the basis of discharge data. Hence, it is possible to effectively obtain a further large detection signal when it is tested whether liquid is discharged from the nozzle. Note that the above method may add a step that implements a function of the above described liquid discharging apparatus.

Further another aspect of the invention provides a program the implements the above described method and that is executed on one or more computers. The program may be recorded on a computer readable recording medium (for example, hard disk, ROM, FD, CD, DVD, or the like), or may be distributed from a computer to another computer through a transmission medium (network such as the Internet or a LAN) or may be exchanged in any form other than the above. When the above program is executed on one computer or executed on a plurality of computers in a distributed manner, the above described method may be executed, so that the same function and advantageous effects may be obtained as in the case of the above described method.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
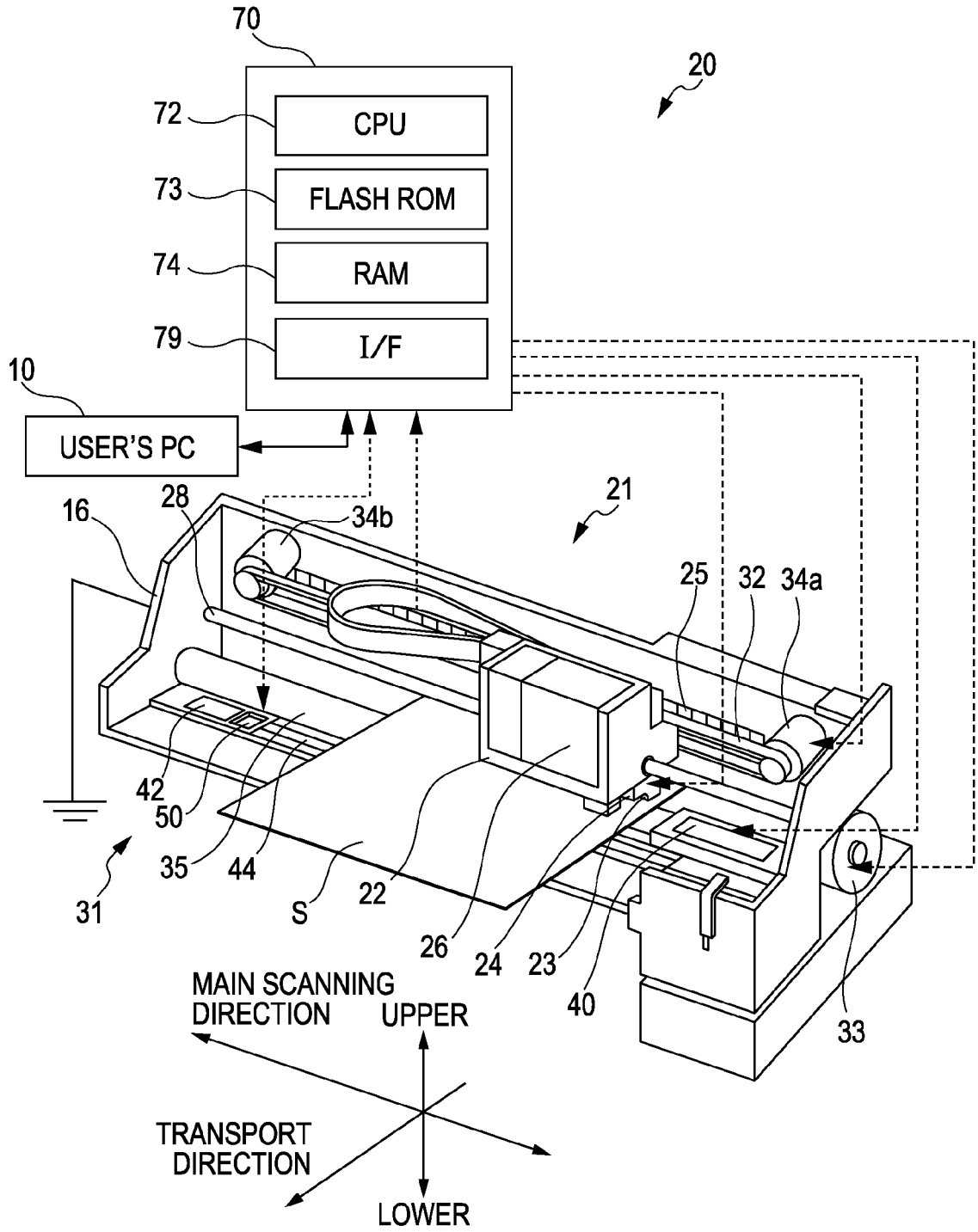
FIG. 1 is a configuration diagram that shows the schematic configuration of an ink jet printer.
Figure 2:
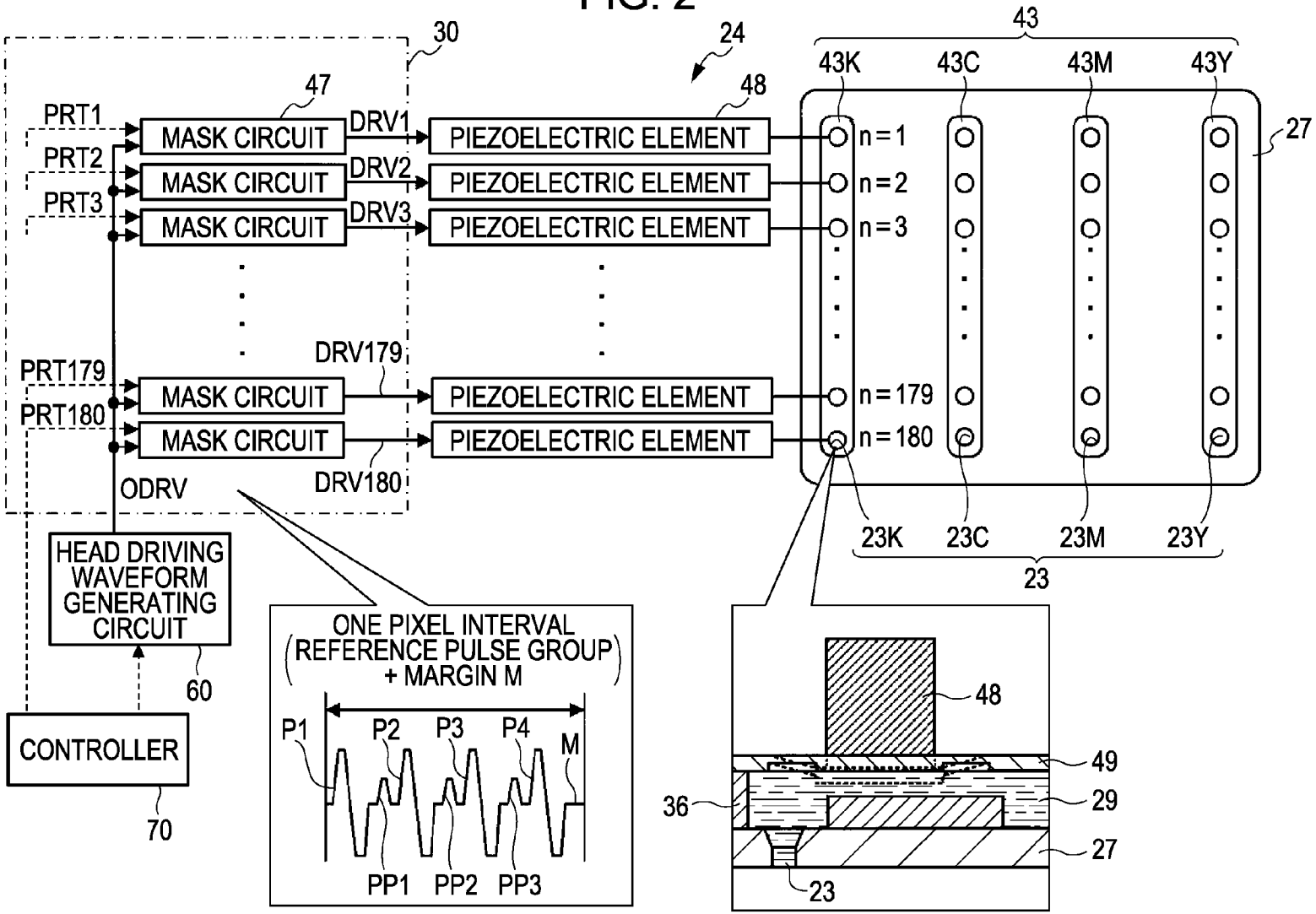
FIG. 2 is a view that illustrates a print head.
Figure 3:
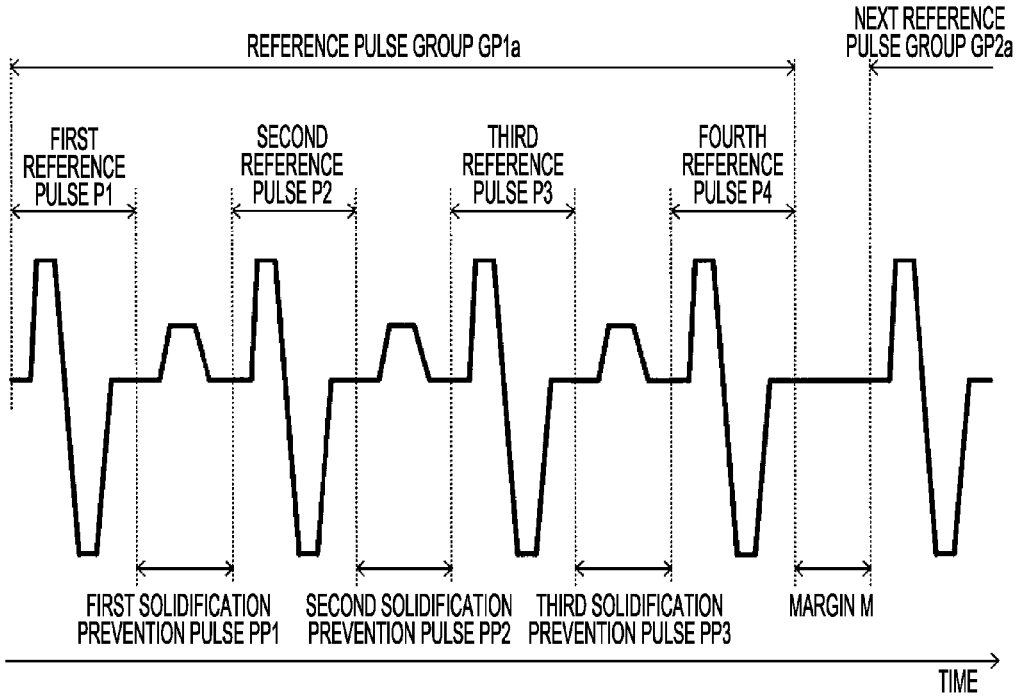
FIG. 3 is a view that illustrates an example of an original signal at the time of normal printing.
Figure 4:
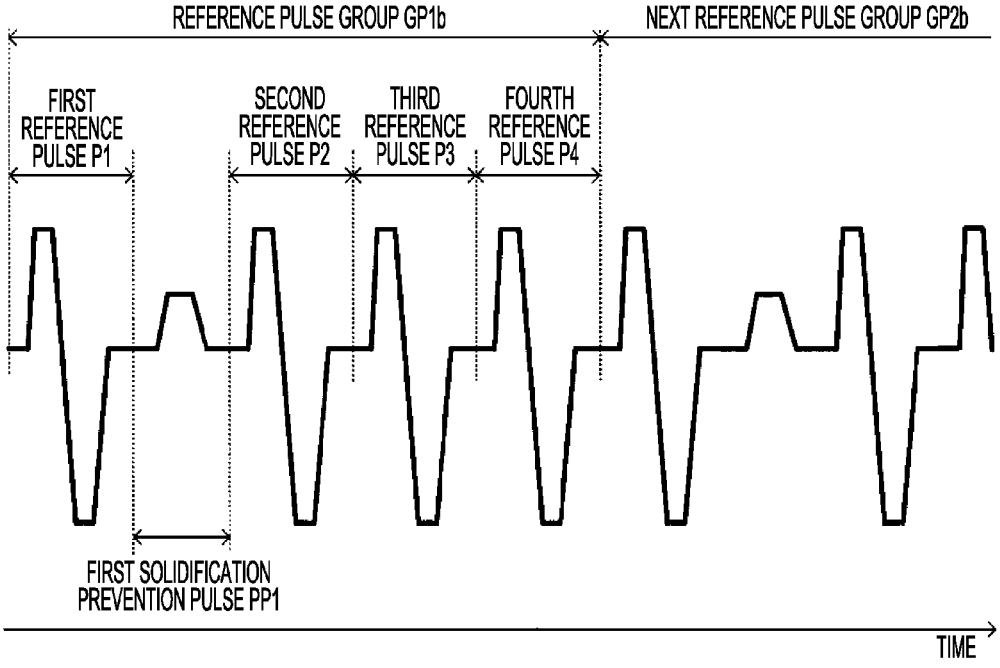
FIG. 4 is a view that illustrates an example of an original signal at the time of nozzle testing.
Figure 5:
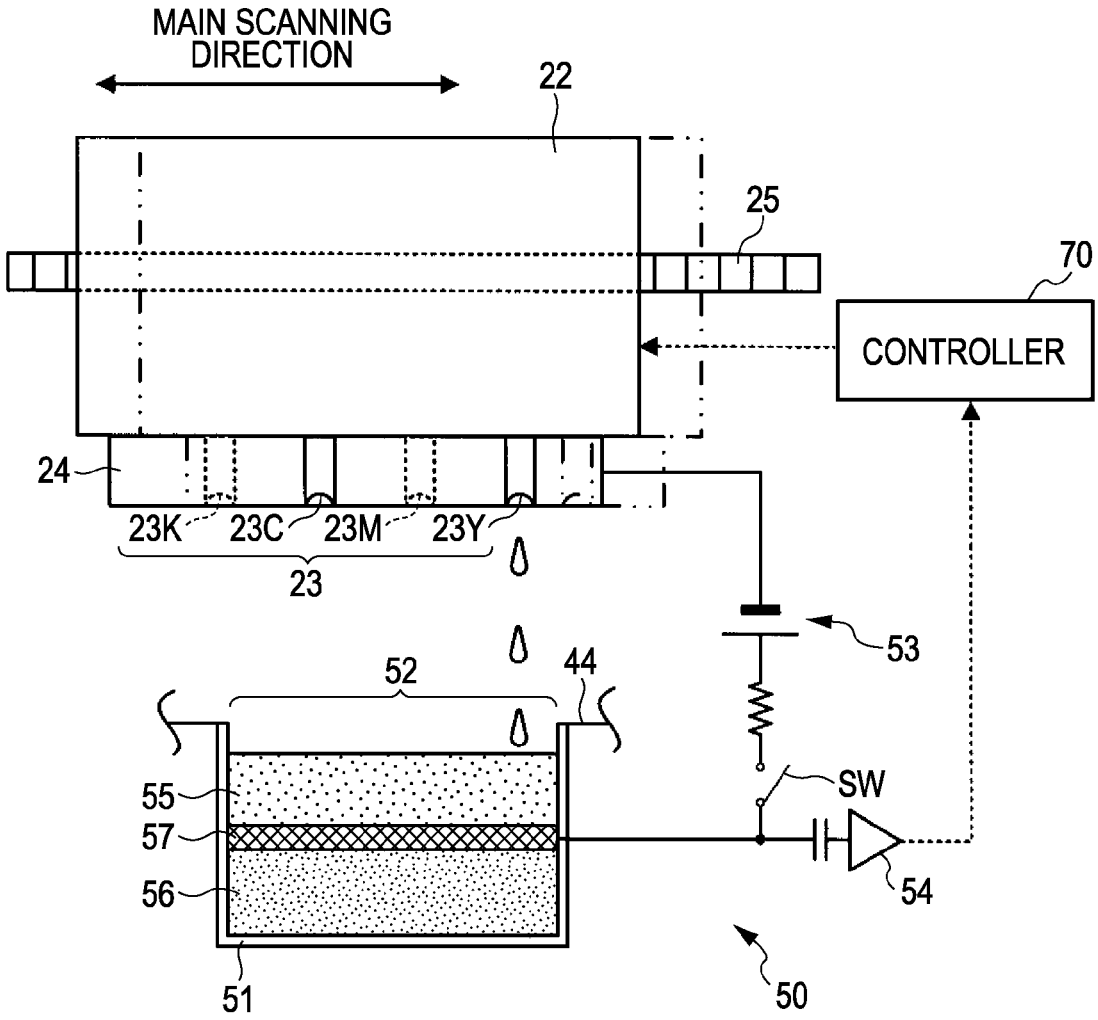
FIG. 5 is a configuration diagram that schematically shows the configuration of a nozzle test device.

An embodiment according to the invention will now be described. FIG. 1 is a configuration diagram that shows the schematic configuration of an ink jet printer 20. FIG. 2 is a view that illustrates the electrical connection of a print head 24. FIG. 3 is a view that illustrates a reference pulse group GP1*a* included in an original signal ODRVa that is used when a normal print job is performed. FIG. 4 is a view that illustrates a reference pulse group GP1*b* included in an original signal ODRVb when a nozzle 23 is tested. FIG. 5 is a configuration diagram that schematically shows the configuration of a nozzle test device 50.

As shown in FIG. 1, the ink jet printer 20 of the present embodiment includes a paper feeding mechanism 31, a printer mechanism 21, a capping device 40, a flushing area 42, a nozzle test device 50 and a controller 70. The paper feeding mechanism 31 transports a recording sheet S from the rear side to the front side (transport direction) in the drawing by a paper feed roller 35 being driven by a drive motor 33. The printer mechanism 21 discharges ink droplets from the print head 24 toward the recording sheet S that is transported onto a platen 44 by the paper feeding mechanism 31 to perform printing. The capping device 40 is formed at the right-hand end of the platen 44, seals the print head 24 and vacuums ink inside the print head 24 using a pump (not shown) where necessary to thereby perform cleaning. The flushing area 42 is formed at the left-hand end of the platen 44 in the drawing and is used to perform flushing operation for discharging ink droplets at a predetermined timing regardless of print data in order to prevent ink from being dried and solidified at nozzle distal ends of the print head 24. The nozzle test device 50 is formed next to the flushing area 42 on the platen 44 and executes nozzle testing as to whether ink droplets are discharged from the nozzles 23 of the print head 24. The controller 70 controls the entire ink jet printer 20.

The printer mechanism 21 includes a carriage motor 34*a*, a driven roller 34*b*, a carriage belt 32, a carriage 22, an ink cartridge 26, and a print head 24. The carriage motor 34*a* is arranged at the right-hand side of a mechanical frame 16. The driven roller 34*b* is arranged at the left-hand side of the mechanical frame 16. The carriage belt 32 is suspended between the carriage motor 34*a* and the driven roller 34*b*. The carriage 22 reciprocally moves from side to side (main scanning direction) along a guide 28 by the carriage belt 32 being driven by the carriage motor 34*a*. The ink cartridge 26 is mounted on the carriage 22 and individually contains yellow (Y) ink, magenta (M) ink, cyan (C) ink and black (K) ink, each of which is formed of water, as a solvent, and dye or pigment, as a coloring agent, contained in the water. The print head 24 is supplied with ink from the ink cartridge 26 and discharges ink droplets. Incidentally, a linear encoder 25 that detects the position of the carriage 22 is arranged on the rear side of the carriage 22. This linear encoder 25 manages the position of the carriage 22. As shown in FIG. 2, the print head 24 includes a stainless nozzle plate 27, a cavity plate 36, ceramic (for example, zirconia ceramic) diaphragms 49, piezoelectric elements 48 (for example, lead zirconate titanate), and mask circuits 47. The nozzle plate 27 has four columns of nozzle arrays 43C, 43M, 43Y and 43K, which respectively include a plurality of cyan (C) nozzles 23C, a plurality of magenta (M) nozzles 23M, a plurality of yellow (Y) nozzles 23Y, and a plurality of black (K) nozzles 23K that are arranged in a column (the number of nozzles is 180 for each column in the present embodiment). The cavity plate 36 cooperates with the nozzle plate 27 to form ink chambers 29 that are respectively in fluid communication with the nozzles 23. The diaphragms 49 each form a top wall of a corresponding one of the ink chambers 29. The piezoelectric elements 48 are attached to the upper face of the corresponding diaphragms 49. The mask circuits 47 are formed on a head driving substrate 30 and serve as driving circuits, each of which outputs a driving signal to the corresponding piezoelectric element 48. A voltage is applied from the mask circuit 47 to the corresponding piezoelectric element 48 to thereby press the upper wall of the ink chamber 29 downward with the piezoelectric element 48, thus pressurizing ink to discharge an ink droplet. Here, the nozzles 23C, 23M, 23Y and 23K are collectively termed as nozzles 23, and the nozzle arrays 43C, 43M, 43Y and 43K are collectively termed as nozzle arrays 43. Hereinafter, driving of the print head 24 will be described using the black (K) nozzles 23K.

Each mask circuit 47 receives an original signal ODRV and a printing signal PRTn, which are generated by the head driving waveform generating circuit 60, and generates a driving signal DRVn on the basis of the received original signal ODRV and printing signal PRTn and then outputs the driving signal DRVn to the corresponding piezoelectric element 48. Note that the suffix n of the printing signal PRTn and the suffix n of the driving signal DRVn are numbers used for identifying a nozzle included in a nozzle array. In the present example embodiment, each nozzle array consists of 180 nozzles, so that n is an integer in the range of 1 to 180.

The head driving waveform generating circuit 60 mainly outputs, to each of the mask circuits 47, an original signal formed in units of four repetition pulses of a first reference pulse P1, a second reference pulse P2, a third reference pulse P3 and a fourth reference pulse P4, which make black ink discharge from the nozzle 23K, within one pixel interval (a period of time during which the carriage 22 crosses over one pixel), as an original signal ODRV for the black ink nozzle array 43K. Hereinafter, the first reference pulse P1, the second reference pulse P2, the third reference pulse P3 and the fourth reference pulse P4 are collectively termed as a reference pulse P. At this time, the original signal ODRVa used for processing a normal print job is a signal that includes a first reference pulse group GP1*a*, as shown in FIG. 3, and a plurality of reference pulse groups similar to the first reference pulse group GP1*a*. Note that in FIG. 3, portion of a reference pulse group GP2*a*, which is the next reference pulse group to the reference pulse group GP1*a*, is shown. As shown in FIG. 3, the reference pulse group GP1*a* is formed of four reference pulses P1 to P4 that are arranged at predetermined intervals (here, the duration of a solidification prevention pulse) and solidification prevention pulses PP1 to PP3 that are placed between the four reference pulses P1 to P4 to prevent solidification of ink near ink surface of the distal end of a nozzle 23K and not to cause discharging ink. The reference pulses P1 to P4 each are set to change from an intermediate voltage to a decompression voltage that is higher than the intermediate voltage, which deforms the piezoelectric element 48 to be short to thereby reduce the pressure in the ink chamber 29, subsequently change to a pressurization voltage that is lower than the intermediate voltage, which deforms the piezoelectric element 48 to be long to thereby make ink protrude from the nozzle 23K, and change again to the intermediate voltage, which deforms the piezoelectric element 48 to return to the original length to thereby separate ink from ink that remains in the ink chamber 29. The solidification prevention pulses PP1 to PP4 each are set to change from the intermediate voltage to a prevention voltage that is higher than the intermediate voltage, which deforms the piezoelectric element 48 to be short to thereby reduce the pressure in the ink chamber 29 to draw the ink surface of the distal end of the nozzle 23 upward, and change again to the intermediate voltage, which deforms the piezoelectric element 48 to return to the original length to thereby return the ink surface to the original position so as not to solidify ink near the ink surface of the distal end of the nozzle 23. In addition, a temporal margin M is included between the reference pulse group GP1*a* and the next reference pulse group GP2*a* in order to position the print head 24 to a pixel position to which ink is discharged while the carriage 22 is moved in a main scanning direction at the time of printing.

The original signal ODRVb at the time of execution of nozzle testing, which will be described later, as to whether ink is discharged from a nozzle 23 is an signal that includes a reference pulse group GP1*b*, as shown in FIG. 4, and a plurality of reference pulse groups similar to the reference pulse group GP1*b*. Note that in FIG. 4, portion of a reference pulse group GP2*b*, which is the next reference pulse group to the reference pulse group GP1*b*, is shown. As shown in FIG. 4, the reference pulse group GP1*b* is formed of four reference pulses P1 to P4 and a solidification prevention pulse PP1. The reference pulses P1 to P4 are the same pulses as those of the reference pulses P1 to P4 included in the original signal ODRVa (see FIG. 3). As described above, the reference pulses P1 to P4 each are set to change from the intermediate voltage to the decompression voltage that is higher than the intermediate voltage to reduce the pressure in the ink chamber 29, subsequently change to the pressurization voltage that is lower than the intermediate voltage to make ink protrude from the nozzle 23K, and change again to the intermediate voltage to separate ink from ink that remains in the ink chamber 29. The solidification prevention pulse PP1 is set to change from the intermediate voltage to the prevention voltage that is higher than the intermediate voltage to draw ink at the distal end of the nozzle 23K upward, and change again to the intermediate voltage to return the ink to the original position to thereby prevent solidification of ink at the distal end of the nozzle 23. In addition, the original signal ODRVb is set not to provide a margin M between the reference pulse groups GP. For example, as shown in FIG. 4, the next reference pulse group GP2*b* is set to be placed immediately after the reference pulse group GP1*b*. In this way, in comparison with the original signal ODRVa at the time of normal printing, the original signal ODRVb is set to have a short interval between the plurality of reference pulses, that is, the second solidification prevention pulse and the third solidification prevention pulse are omitted and the intervals between the two adjacent reference pulses P that place these solidification prevention pulses in between are short, and, in addition, because of no margin M included, the interval between the reference pulse groups GP is short, that is, the interval between the fourth reference pulse and the first reference pulse of the next reference pulse group GP is short, to thereby increase the number of reference pulses P included in unit time. Hereinafter, the original signal ODRVa and the original signal ODRVb are collectively termed as the original signal ODRV. In addition, the first solidification prevention pulse PP1, the second solidification prevention pulse PP2 and the third solidification prevention pulse PP3 are collectively termed as the solidification prevention pulse PP. Furthermore, the reference pulse group GP1*a*, the next reference pulse group GP2*a* and a plurality of other reference pulse groups, which are included in each original signal ODRV, are collectively termed as the reference pulse group GP.

As shown in FIG. 2, each mask circuit 47 masks an unnecessary pulse among the four pulses included in an input original signal ODRV on the basis of a separately input printing signal PRTn to thereby output only a necessary pulse to the piezoelectric element 48 of the corresponding nozzle 23K as the driving signal DRVn. At this time, as only the first reference pulse P1 is output to the piezoelectric element 48 as the driving signal DRVn, a one-shot ink droplet is discharged from the nozzle 23K to form a minimum-size dot (minimum dot) on the recording sheet S. As the first reference pulse P1 and the second reference pulse P2 are output to the piezoelectric element 48, two-shot ink droplets are discharged from the nozzle 23K to form a small-size dot (small dot) on the recording sheet S. As the first reference pulse P1, second reference pulse P2 and third reference pulse P3 are output to the piezoelectric element 48, three-shot ink droplets are discharged from the nozzle 23K to form a middle-size dot (middle dot) on the recording sheet S. As the first reference pulse P1, second reference pulse P2, third reference pulse P3 and fourth reference pulse P4 are output to the piezoelectric element 48, four-shot ink droplets are discharged from the nozzle 23K to form a large-size dot (large dot) on the recording sheet S. In this way, the ink jet printer 20 is able to form four sizes of dots by adjusting the amount of ink discharged during one pixel interval. Note that the nozzles that discharge ink in this way are not likely to produce solidification of ink, so that all the solidification prevention pulses PP are masked. In addition, the nozzle 23K that does not discharge ink is subjected to prevention of ink solidification by outputting the driving signal DRVn including only the solidification pulses PP to the piezoelectric element 48 with all the reference pulses P masked. Note that the other color ink nozzles 23C, 23M and 23Y and nozzle arrays 43C, 43M and 43Y are similar to the black (K) ink nozzle 23K and nozzle array 43K, respectively.

As shown in FIG. 5, the nozzle test device 50 includes a test box 51, an ink receiving area 52, a voltage applying circuit 53 and a voltage detection circuit 54. The test box 51 is able to receive ink droplets flying from the nozzles 23 of the print head 24 so as to land on the test box 51. The ink receiving area 52 is provided in the test box 51. The voltage applying circuit 53 applies a voltage between the ink receiving area 52 and the print head 24. The voltage detection circuit 54 detects a voltage that is generated at the ink receiving area 52. The test box 51 is a substantially box-shaped casing having an opening at its top end. The test box 51 is provided at a position that is located to the left-hand side outside a printable area of the platen 44. The ink receiving area 52 is provided inside the test box 51. The ink receiving area 52 includes an upper ink absorber 55, a lower ink absorber 56 and a meshed electrode member 57. The upper ink absorber 55 receives ink droplets that directly land thereon. The lower ink absorber 56 absorbs ink droplets that permeates downward after the ink droplets have landed on the upper ink absorber 55. The electrode member 57 is arranged between the upper ink absorber 55 and the lower ink absorber 56. The upper ink absorber 55 is formed of a conductive sponge so as to have the same electric potential as the electrode member 57. The sponge has high permeability such that landed ink droplets are able to move downward. Here, the sponge employs an ester-based urethane sponge (product name: Ever Light SK-E, manufactured by Bridgestone Corporation). The ink receiving area 52 corresponds to the surface of the upper ink absorber 55. The lower ink absorber 56 holds ink more than the upper ink absorber 55 does. The lower ink absorber 56 is made of non-woven fabric such as felt and, here, uses a non-woven fabric (product name: Kinocloth, manufactured by Oji Kinocloth, Co., Ltd.). The electrode member 57 is formed as a lattice mesh made of stainless metal (for example, SUS). Thus, ink that is once absorbed by the upper ink absorber 55 penetrates through interstices formed in the lattice electrode member 57 to be absorbed and held by the lower ink absorber 56. The length of the ink receiving area 52 in the transport direction is designed to be larger than that of the nozzle array 43. Note that the upper ink absorber 55 and the lower ink absorber 56 may be omitted.

The voltage applying circuit 53 boosts a voltage of several volts applied in an electrical wiring that is routed inside the ink jet printer 20 to a predetermined direct-current voltage Ve of several tens to several hundreds of volts through a booster circuit (not shown), and applies the boosted direct-current voltage Ve to the nozzle plate 27 of the print head 24 through a switch SW. The voltage detection circuit 54 is connected to the nozzle plate 27. The voltage detection circuit 54 integrates and inverting-amplifies a voltage signal of the nozzle plate 27, and then analog/digital converts the signal and outputs the converted signal to the controller 70. Note that the voltage detection circuit 54 and the booster circuit (not shown) are mounted on the head driving substrate 30.

As shown in FIG. 1, the controller 70 is formed of a microprocessor that mainly includes a CPU 72. The controller 70 includes a flash ROM 73, a RAM 74, an interface (I/F) 79 and an input/output port (not shown). The flash ROM 73 stores various processing programs. The RAM 74 temporarily stores and/or saves data. The I/F 79 exchanges information with external devices. The RAM 74 provides a print buffer area in which print data transmitted from a user's PC 10 through the I/F 79 are stored. The controller 70 receives a voltage signal from the voltage detection circuit 54 or a signal indicating the position of the carriage 22 from the linear encoder 25, which are input through an input port (not shown), and receives a print job, or the like, output from the user's PC 10 and input through the I/F 79. In addition, the controller 70 outputs a control signal to the print head 24 (including the mask circuits 47 and the piezoelectric elements 48), a switching signal to the switch SW, a control signal to the head driving waveform generating circuit 60, and a driving signal to the drive motor 33, a driving signal to the carriage motor 34a, and the like, through an output port (not shown), and outputs print status information to the user's PC 10, or the like, through the I/F 79.

Figure 6:
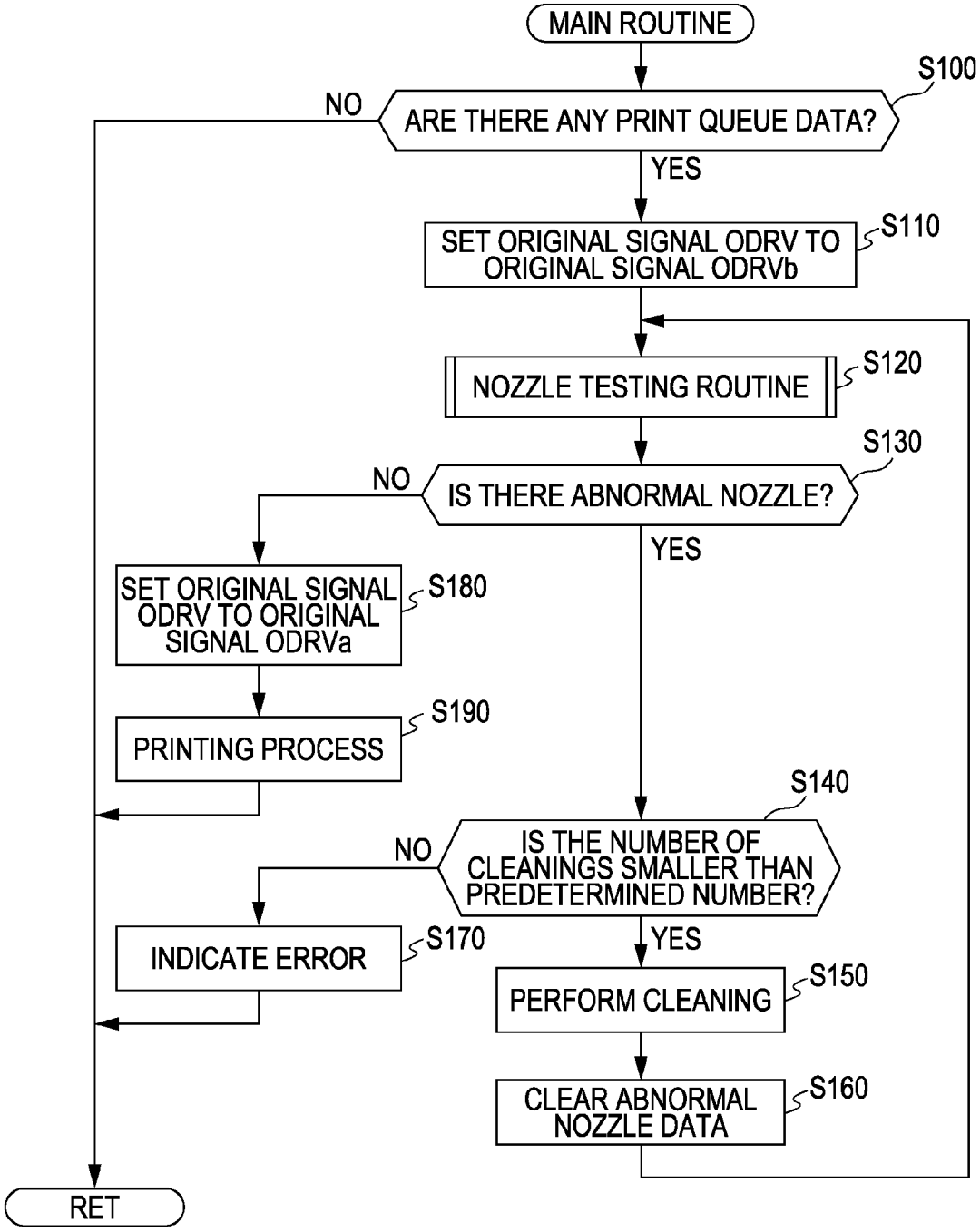
FIG. 6 is a flowchart that shows an example of a main routine.

The operation of the thus configured ink jet printer 20 according to present embodiment will now be described. FIG. 6 is a flowchart that shows an example of a main routine executed by the CPU 72 of the controller 70. The main routine is stored in the flash ROM 73 and is executed by the CPU 72 at predetermined intervals (for example, at intervals of several msec) after the power of the ink jet printer 20 is turned on. As the routine is started, the CPU 72 initially determines whether there are any print queue data (step S100). Here, print data received from the user's PC 10 will be stored in a print buffer area formed in the RAM 74 and become print queue data, so that not only in a case in which printing is being performed when print data are received but also in a case in which printing may be performed immediately, received print data will become print queue data. When it is determined that there are no print queue data in step S100, the routine ends without proceeding to the following steps. On the other hand, when it is determined in step S100 that there are print queue data, the original signal ODRV, which will be generated by the head driving waveform generating circuit 60, is set to the above described original signal ODRVb (see FIG. 4) at the time of nozzle testing (step S110), and then the original signal ODRVb is used to execute a nozzle testing routine (step S120), which will be described later. Although not specifically described here and will be described later in detail, in the nozzle testing routine, if there is an abnormal nozzle in which abnormality such as nozzle clogging is occurring, information that identifies the abnormal nozzle will be stored in a predetermined area of the RAM 74.

Next, the CPU 72 determines on the basis of the content stored in the predetermined area of the RAM 74 whether there is an abnormal nozzle 23, at which abnormality is occurring, among all the nozzles 23 arrayed on the print head 24 (step S130). If there is an abnormal nozzle 23, cleaning of the print head 24 is performed in consideration of nozzle clogging; however, before that, it is determined whether the number of cleanings is smaller than a predetermined number (for example, three) (step S140). Then, when it is determined that the number of cleanings is smaller than a predetermined number, cleaning of the print head 24 is performed (step S150). Specifically, the carriage 22 is moved by driving the carriage motor 34*a* so that the print head 24 is located at a home position at which the print head 24 faces the capping device 40, the capping device 40 is operated so that the capping device 40 covers a nozzle forming face of the print head 24, and then a negative pressure from a vacuum pump (not shown) is applied to the nozzle forming face to thereby vacuum and drain clogged ink from the nozzles 23. After the cleaning, information regarding abnormal nozzles, stored in the RAM 74, is cleared (step S160), and the process returns to step S120 in order to test whether abnormal discharge of the nozzles 23 is eliminated. Note that, in step S120, it is applicable that only the nozzles 23 in which abnormality has been occurring are retested; however, nozzle clogging may occur in the nozzles 23 that was normal at the time of cleaning because of some reasons, so that all the nozzles 23 of the print head 24 are retested. On the other hand, when it is determined in step S140 that the number of cleanings is equal to or larger than a predetermined number, it is regarded that the abnormal nozzles would not recover even with a further cleaning, and indicates an error message on an operation panel (not shown) (step S170), after which the main routine ends. In this way, all the nozzles 23 of the print head 24 are tested whether nozzle clogging is occurring and, if nozzle clogging is occurring, cleaning is performed below a predetermined upper limit number to thereby eliminate nozzle clogging.

On the other hand, it is determined in step S130 that there is no abnormal nozzle 23, that is, ink is able to be discharged from all the nozzles 23, the CPU 72 sets the original signal ODRV, which will be generated by the head driving waveform generating circuit 60, to the above described original signal ODRVa (see FIG. 3) at the time of normal printing (step S180), and performs a printing process using the original signal ODRVa (step S190). The printing process controls the head driving waveform generating circuit 60 to generate the above described original signal ODRVa (see FIG. 3) at the time of normal printing and then alternately repeats a process in which, while the carriage 22 is moved in the main scanning direction by driving the carriage motor 34*a*, the piezoelectric elements 48 of the print head 24 are driven by the driving signals DRVn that are generated from the corresponding printing signals PRTn and original signals ODRVa generated on the basis of a print job to thereby discharge ink and a process in which the paper feed roller 35 is driven for rotation to transport a recording sheet S by a predetermined amount.

Here, the CPU 72 generates, as the printing signal PRTn, a signal by which the driving signal DRVn in which the solidification prevention pulses PP of the original signal ODRV are masked and a portion of or entire reference pulses P are masked on the basis of a print job is input to the piezoelectric element 48 that drives a nozzle 23 to discharge ink and the driving signal DRVn in which the reference pulses P of the original signal ODRV are masked is input to the piezoelectric element 48 that drives a nozzle 23 not to discharge ink, and outputs the generated signal to each of the mask circuits 47.

Figure 7:
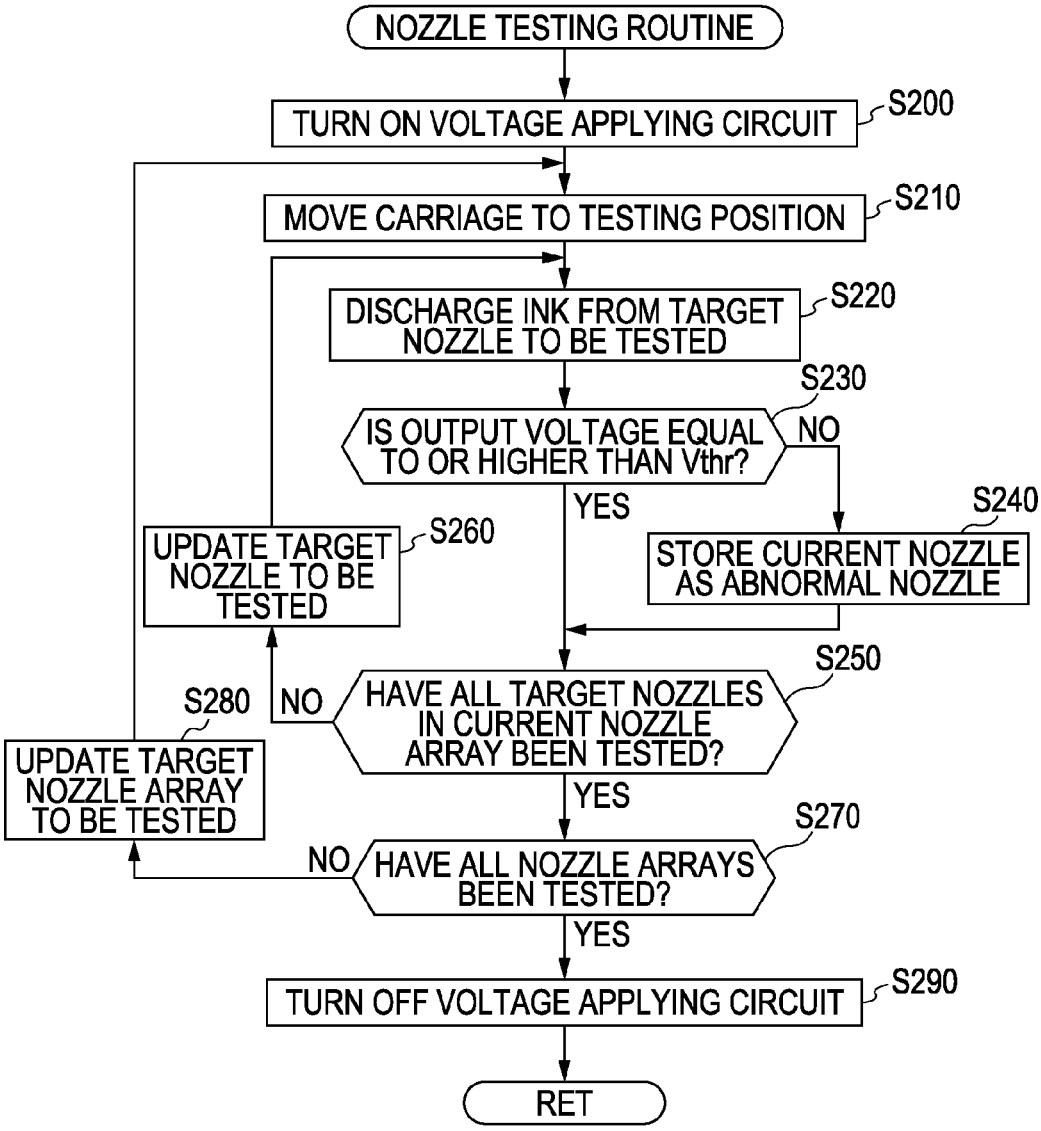
FIG. 7 is a flowchart that shows an example of a nozzle testing routine.

The nozzle testing routine will now be described. As shown in FIG. 7, this routine includes a nozzle testing process that tests whether there is a clogged nozzle 23 arranged on the print head 24, that is, whether ink is discharged from the nozzles 23, and is stored in the flash ROM 73. As the routine is started, the CPU 72 turns on the switch SW of the voltage applying circuit 53 (step S200). Then, the carriage motor 34*a* is driven to move the carriage 22 so that the target nozzle array 43 to be tested, out of the nozzle arrays 43 of the print head 24, faces a predetermined testing position (step S210), and makes an electrically charged ink droplet be discharged from a nozzle 23 included in the target nozzle array 43 using the mask circuit 47 and the piezoelectric element 48 (see FIG. 2) of the nozzle 23 (step S220). Here, for the piezoelectric element 48 that drives the target nozzle 23, the driving signal DRVn is generated on the basis of the printing signal PRTn, in which the first solidification prevention pulse PP1 is masked and all the reference pulses P1 to P4 are not masked, and the original signal ODRVb at the time of nozzle testing, and for nontarget nozzles, the driving signal DRVn is generated on the basis of the printing signal PRTn, in which all the reference pulses P1 to P4 are masked and the first solidification prevention pulse PP1 is not masked, and the original signal ODRVb at the time of nozzle testing to thereby drive the head. In addition, the nozzles 23 are set so as to discharge ink from the nozzle 23, having a smallest nozzle number n, included in the nozzle array 43 at the time of start of testing.

A voltage of the ink receiving area 52 changes from when a negatively charged ink droplet flies from a nozzle 23 until when the ink droplet lands on the ink receiving area 52, and the voltage detection circuit 54 detects this change. This experiment was performed actually, and a voltage detected by the voltage detection circuit 54 showed a sine curve. Although it is not evident that the principle that gives such a sine curve, it is presumably caused by an induced current flowing due to electrostatic induction as an electrically charged ink droplet approaches the ink receiving area 52. In addition, the amplitude of the output signal waveform output from the voltage detection circuit 54 showed that as a distance from the print head 24 to the upper ink absorber 55 (ink receiving area 52) is reduced, the output signal increases, and as the size of a flying ink droplet increases, the output signal increases. For this reason, when an ink droplet does not fly because of a clogged nozzle 23 or the size of an ink droplet is smaller than a predetermined size, the amplitude of an output signal waveform would be smaller than that at normal time or be substantially zero, so that it is possible to determine the presence of a clogged nozzle 23 on the basis of whether the amplitude of an output signal waveform falls below a predetermined threshold. In the present embodiment, although an ink droplet has a predetermined size, the amplitude of an output signal waveform owing to one-shot ink droplet is weak, so that 24-shot ink droplets were discharged by performing six times the operation to output all the four pulses in one pixel interval, which represents a driving waveform. In this manner, because the output signal will be a value integrated by 24-shot ink droplets, a sufficiently large output signal waveform was obtained from the voltage detection circuit 54. Note that the number of ink discharged may be selectively set so as to attain the number of discharges by which detection accuracy may be ensured. Here, nozzle testing may be executed using the original signal ODRVa at the time of normal printing as shown in FIG. 3, and, as described above, in comparison with the time of normal printing, the interval between a portion of reference pulses are short at the time of nozzle testing, that is, the interval between times at which electrically charged ink droplet is discharged is short, so that the amount of a voltage change detected per unit time is large. For example, voltage changes may be superimposed and, therefore, may be detected as a further large change. Thus, using the original signal ODRVb presumably allows a further large voltage change to be detected by the voltage detection circuit 54 in comparison with the case in which the original signal ODRVa is used.

Now referring back to the nozzle testing routine shown in FIG. 7, the CPU 72 determines whether the amplitude or output level of a signal waveform detected by the voltage detection circuit 54 is equal to or larger than a threshold Vthr (step S230). The threshold Vthr is an empirically determined value such that the output level (peak value) of an output signal waveform exceeds the threshold Vthr when 24-shot ink is normally discharged and the output level does not exceed the threshold Vthr when 24-shot ink is not normally discharged because of noise, or the like. When it is determined in step S230 that the output level is lower than the threshold Vthr, it is assumed that abnormality such as clogging is occurring in the current nozzle 23 and stores information (for example, information that indicates what number nozzle and which nozzle array) that identifies the nozzle 23 in the RAM 74 (step S240). After step S240 or when it is determined in step S230 that the output level is equal to or higher than the threshold Vthr (that is, when it is determined that the current nozzle 23 is normal), it is determined whether all the nozzles 23 included in the currently testing nozzle array 43 have been tested (step S250). When it is determined that there is an untested nozzle 23 in the currently testing nozzle array, the target nozzle 23 is updated to the untested one (step S260) and, after that, the processes of steps S210 to S260 will be performed again. On the other hand, when it is determined in step S250 that all the nozzles 23 in the currently testing nozzle array have been tested, it is determined whether all the nozzle arrays 43 included in the print head 24 have been tested (step S270). When it is determined that there is an untested nozzle array 43, the target nozzle array 43 is updated to the untested nozzle array 43 (step S280) and, after that, the processes of steps S210 to S280 will be performed. That is, in the processes of steps S210 to S280, the print head 24 is moved to a predetermined testing position, ink is discharged from all the nozzles 23 in each nozzle array 43 and then it is determined whether ink is discharged from the nozzles 23 on the basis of the voltage values detected by the voltage detection circuit 54. On the other hand, it is determined in step S270 that all the nozzle arrays 43 included in the print head 24 have been tested, the CPU 72 turns off the switch SW of the voltage applying circuit 53 (step S290) and ends the routine.

Referring back to the main routine shown in FIG. 6, the CPU 72 performs a printing process in step S170 and then ends the routine. In this way, at the time of normal printing, the driving signal DRVn is generated using the original signal ODRVa to drive the print head 24, and at the time of nozzle testing, the driving signal DRVn is generated using the original signal ODRVb, in which a plurality of solidification prevention pulses PP are omitted to set a short interval between a plurality of reference pulses, to drive the print head 24.

Here, the correspondence relationship between the components of the present embodiment and the components of the aspects of the invention will be clarified. The ink jet printer 20 of the present embodiment may be regarded as a liquid discharging apparatus according to the aspects of the invention. The print head 24 may be regarded as a discharging device. The ink receiving area 52 may be regarded as a liquid receiving device. The voltage applying circuit 53 may be regarded as a voltage applying device. The voltage detection circuit 54 may be regarded as an electrical change detection device. The head driving waveform generating circuit 60 may be regarded as a driving signal generating device. The controller 70 may be regarded as a control device. The printing signal PRTn may be regarded as discharge data. The recording sheet S may be regarded as a target. The original signal ODRVa at the time of normal printing may be regarded as a discharge data driving signal. The original signal ODRVb at the time of nozzle testing may be regarded as a test driving signal. The solidification prevention pulses PP1 to PP3 may be regarded as a micro-oscillation waveform. Note that in the present embodiment, by describing the operation of the ink jet printer 20, an example of a method of controlling the liquid discharging apparatus according to the aspects of the invention is described.

According to the ink jet printer 20 of the present embodiment as described above in detail, at the time of normal printing, the original signal ODRVa that drives the print head 24 is generated so that the solidification prevention pulse PP with a certain length of time is included between the plurality of reference pulses P1 to P4, and at the time of nozzle testing, the original signal ODRVb that drives the print head 24 is generated so that two solidification prevention pulses PP2 and PP3 are omitted and a temporal margin M, required for positioning the carriage 22, is not included between the reference pulse groups GP to thereby shorten the intervals between the second reference pulse P2 and the third reference pulse P3, between the third reference pulse P3 and the fourth reference pulse P4, and between the fourth reference pulse P4 and the first reference pulse P1 of the next reference pulse group GP. Then, a printing process is performed using the generated original signal ODRVa at the time of normal printing, whereas at the time of nozzle testing, nozzle testing is performed using the generated original signal ODRVb to determine whether ink is discharged from a nozzle 23. In this way, at the time of nozzle testing, the number of ink droplets that can be detected per unit time is increased by shortening the interval between one or more reference pulses P, and a voltage change detected per unit time is increased as compared with the case in which the same original signal ODRVa as that at the time of normal printing is used to perform testing. Thus, it is possible to effectively obtain a further large detection signal when it is tested whether ink is discharged from a nozzle 23. As a result, it is possible to reduce the number of ink droplets discharged for obtaining a sufficient output level, it is possible to perform testing for a further short period of time, and it is possible to further reliably perform testing. In addition, a further large value may be set as a threshold Vthr, with which it is determined whether ink is discharged, without further reducing the number of ink droplets being discharged, it is possible to prevent erroneous detection due to noise. In addition, at the time of nozzle testing, by shortening the interval between the reference pulse groups GP, it is possible to increase a voltage change detected per unit time as compared with the case in which nozzle testing is performed using the same original signal ODRVa as that at the time of normal printing. Moreover, at the time of nozzle testing, by generating the original signal ODRVb that does not include an unnecessary temporal margin M for positioning the carriage 22, it is possible to increase a voltage change detected per unit time as compared with the case in which nozzle testing is performed using the same original signal ODRVa as that at the time of normal printing. Furthermore, at the time of nozzle testing, the original signal ODRVb is generated so that the number of solidification prevention pulses PP that cause little influence even when a portion of them are omitted from a normal driving signal is reduced and the interval of two reference pulses that have placed the omitted solidification pulse in between is shortened as compared with the interval of other reference pulses. Thus, it is possible to increase a voltage change detected per unit time as compared with the case in which nozzle testing is performed using the same original signal ODRVa as that at the time of normal printing.

The aspects of the invention are not limited to the above described embodiment, but it may be modified into various forms within the scope of the invention.

Figure 8:
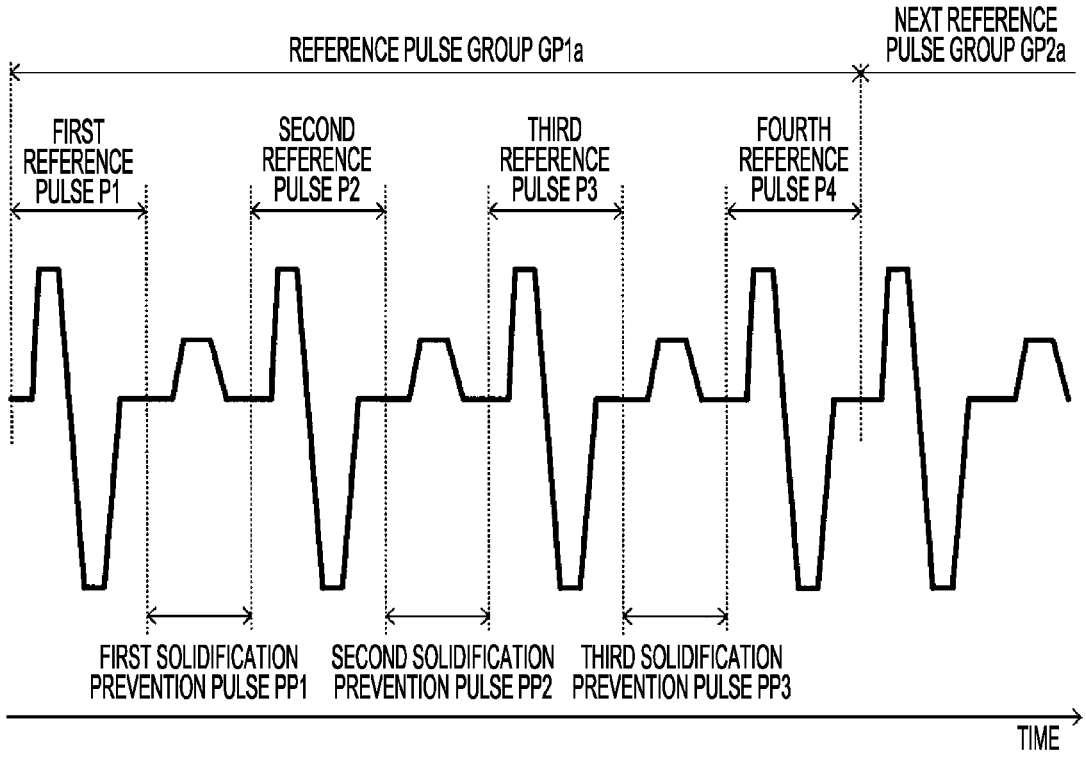
FIG. 8 is a view that illustrates an original signal at the time of another nozzle testing.

For example, in the above described embodiment, the head driving waveform generating circuit 60 generates, as the original signal ODRVb at the time of nozzle testing, a signal that includes the reference pulse group GP1*b* in which the solidification prevention pulses PP2 and PP3 are omitted and a plurality of reference pulse groups similar to the reference pulse group GP1*b* and that does not include a margin M; however, as shown in FIG. 8, the head driving waveform generating circuit 60 may generate, as the original signal ODRVb, a signal that includes the reference pulse group GP1*a*, in which the solidification prevention pulses PP are included (not omitted), and a plurality of reference pulse groups similar to the reference pulse group GP1*a* and that does not include a margin M. As shown in the drawing, the original signal ODRVb includes the solidification prevention pulses PP1 to PP4 and does not include a margin M. In this case as well, it is possible to increase a voltage change detected per unit time in comparison with the case in which nozzle testing is performed using the same original signal ODRVa as that at the time of normal printing.

In the above described embodiment, the reference pulse group GP1*b* included in the original signal ODRVb at the time of nozzle testing is the one from which two solidification prevention pulses PP2 and PP3 are omitted; however, as far as one or more solidification prevention pulses are omitted, the reference pulse group GP1*b* is not limited to the one from which the solidification prevention pulses PP2 and PP3 are omitted. For example, the reference pulse group GP included in the original signal ODRVb may be the one from which the solidification prevention pulses PP1 and PP2 are omitted or may be the one from which the solidification prevention pulses PP1 and PP3 are omitted. Alternatively, the reference pulse group GP may be the one from which any one of the solidification prevention pulses PP1 to PP3 is omitted. In this case as well, it is possible to increase a voltage change detected per unit time in comparison with the case in which nozzle testing is performed using the same original signal ODRVa as that at the time of normal printing.

In the above described embodiment, the head driving waveform generating circuit 60 generates, as the original signal ODRVb at the time of nozzle testing, a signal that includes the reference pulse group GP1*b*, from which the two solidification prevention pulses PP2 and PP3 are omitted, and a plurality of reference pulse groups similar to the reference pulse group GP1*b* and which does not include a margin M; however, the head driving waveform generating circuit 60 may generate, as the original signal ODRVb, a signal that includes a margin M as far as the head driving waveform generating circuit 60 generates the reference pulse group GP from which at least any one of the solidification prevention pulses PP is omitted. For example, the head driving waveform generating circuit 60 may generate, as the original signal ODRVb, a signal that includes the reference pulse group GP, from which the solidification prevention pulses PP2 and PP3 are omitted, and a plurality of reference pulse groups, similar to the reference pulse group GP, which are provided at an interval of the margin M. In this case as well, it is possible to increase a voltage change detected per unit time in comparison with the case in which nozzle testing is performed using the same original signal ODRVa as that at the time of normal printing.

In the above described embodiment, a solidification prevention pulse PP is omitted from the reference pulse group GP included in the original signal ODRVb at the time of nozzle testing to shorten each interval between the reference pulses P to thereby shorten the overall length of each reference pulse group GP; however, it is applicable that a solidification prevention pulses PP is omitted to shorten each interval between the reference pulses P, and a period of time that has the same length as the omitted solidification prevention pulse PP and during which a voltage does not change is added between other reference pulses P to thereby not shorten the overall length of the reference pulse group GP. In this case as well, voltage changes due to a plurality of ink droplets that are discharged on the basis of a plurality of reference pulses P having a short interval therebetween are superimposed, so that it is possible to further increase a voltage change detected by the voltage detection circuit 54.

In the above described embodiment, a signal that includes the reference pulses P1 to P4 and the solidification prevention pulses PP1 to PP3 is used as the original signal ODRVa at the time of normal printing, and all the solidification prevention pulses PP of the original signal ODRVa are masked is used as the driving signal DRVn; however, as long as a signal that includes reference pulses P of which one or more intervals are shortened is used as the original signal ODRVb at the time of testing, it is not limited to the case in which a signal that includes the reference pulses P1 to P4 and the solidification prevention pulses PP1 to PP3 is used as the original signal ODRVa at the time of normal printing, and all the solidification prevention pulses PP of the original signal ODRVa are masked is used as the driving signal DRVn. For example, a signal that includes the reference pulses P1 to P4 and that does not include all the solidification prevention pulses PP may be used as the original signal ODRVa at the time of normal printing, or a signal that includes the reference pulses P1 to P4 and the solidification prevention pulses PP1 to PP3 may be used as the original signal ODRVa at the time of normal printing, and a portion of or entire solidification prevention pulses PP of the original signal ODRVa are not masked may be used as the driving signal DRVn.

In the above described embodiment, a signal that includes the solidification prevention pulses PP1 to PP3 is used as the original signal ODRVa at the time of normal printing, and a signal, from which the solidification prevention pulses PP1 to PP3 are omitted to shorten one or more intervals between the reference pulses P, is used as the original signal ODRVb at the time of nozzle testing; however, a signal that includes a micro-oscillation waveform, which does not discharge ink, other than the solidification prevention pulses PP1 to PP3, in the interval between the reference pulses P may be used as the original signal ODRVa at the time of normal printing, and a signal, from which the micro-oscillation waveform is omitted to shorten the interval between the reference pulses P, may be used as the original signal ODRVb at the time of nozzle testing. In this case as well, it is possible to increase a voltage change detected per unit time in comparison with the case in which nozzle testing is performed using the same original signal ODRVa as that at the time of normal printing.

In the above described embodiment, the interval between the reference pulse groups GP at the time of nozzle testing is shortened so that the margin M for positioning the print head 24, included in the interval between the reference pulse groups GP at the time of normal printing, is omitted; however, as long as the interval between the reference pulse groups GP at the time of nozzle testing is shortened as compared with the interval between the reference pulse groups GP at the time of normal printing, it is applicable that the interval between the reference pulse groups GP at the time of nozzle testing may be shortened not by omitting the margin for positioning the print head 24, that is, for example, the interval is shortened by omitting a margin, other than the margin for positioning the print head 24, or the like.

Figure 9A:
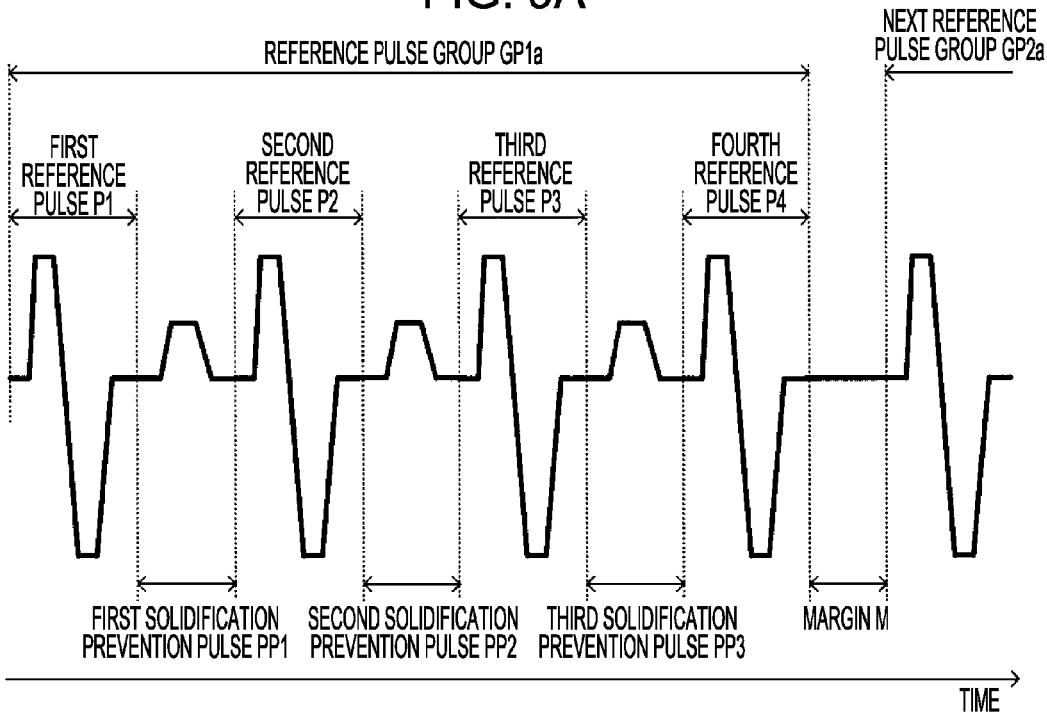
FIG. 9A and FIG. 9B are views that illustrate an original signal at the time of further another nozzle testing.
Figure 9B:
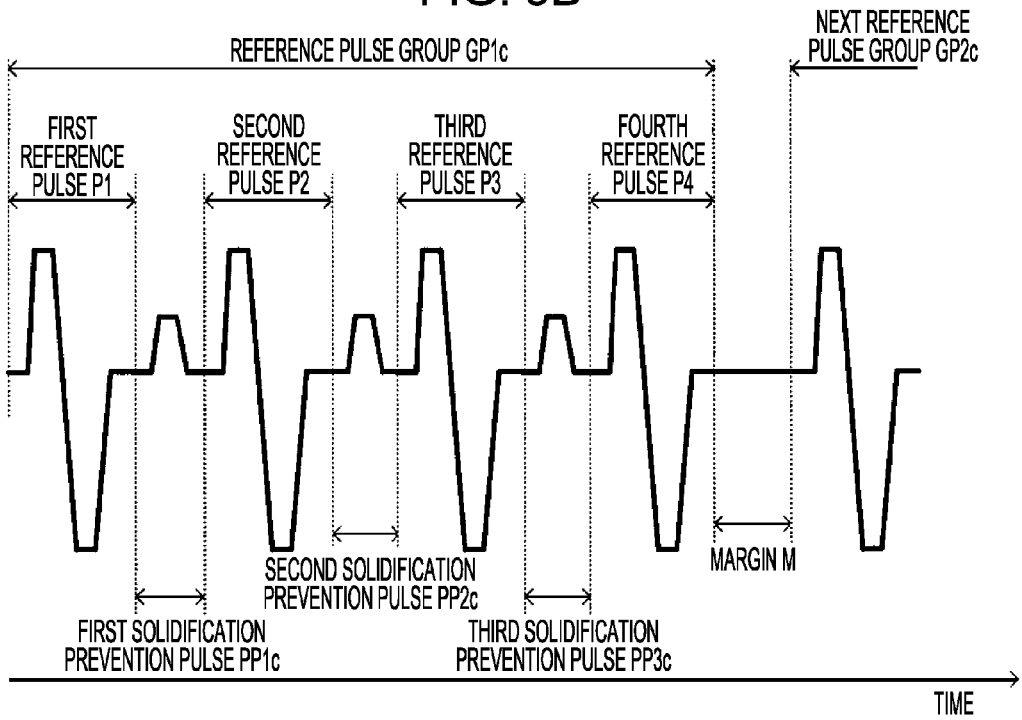

In the above described embodiment, the head driving waveform generating circuit 60 generates, as the original signal ODRVb at the time of nozzle testing, a signal that includes the reference pulse group GP1*b*, from which the two solidification prevention pulses PP2 and PP3 are omitted, and a plurality of reference pulse groups similar to the reference pulse group GP1*b* and that does not include a margin M; however, as long as the head driving waveform generating circuit 60 generates, as the original signal ODRVb, a signal that includes the reference pulse group GP in which the interval between the reference pulses P is shortened, the head driving waveform generating circuit 60 may not be the one that omits the solidification prevention pulses PP. For example, as shown in FIG. 9B, the head driving waveform generating circuit 60 may generate, as the original signal ODRVb, a signal that includes a reference pulse group GP1*c* that includes solidification prevention pulses PP1*c* to PP3*c*, which have a length of time shorter than the solidification prevention pulses PP at the time of normal printing, and a plurality of reference pulse groups similar to the reference pulse group GP1*c*. As shown in the drawing, the solidification prevention pulses included in the reference pulse group GP1*c* (FIG. 9B) of the original signal ODRVb at the time of nozzle testing is shorter in length of time and shorter in interval between reference pulses than the solidification prevention pulses PP of the reference pulse group GP1*a* (FIG. 9A) included in the original signal ODRVa at the time of normal printing. In this case, at the time of nozzle testing, the original signal ODRVb is generated so that the lengths of time of solidification prevention pulses PP that cause little influence even when a portion of them are omitted from the original signal ODRVa are shortened, and the interval of two reference pulses P that have placed the omitted solidification prevention pulse PP in between is further shortened as compared with the interval of other reference pulses. Thus, it is possible to increase a voltage change detected per unit time as compared with the case in which nozzle testing is performed using the same original signal ODRVa as that at the time of normal printing.

In the above described embodiment, as shown in FIG. 2, the print head 24 employs a structure such that as a voltage is applied, the piezoelectric element 48 contracts in a direction perpendicular to the top wall of the ink chamber 29 to thereby reduce a pressure applied to ink in the ink chamber 29; however, the print head 24 may employ a structure such that as a voltage is applied, the piezoelectric element 48 contracts in a direction along the top wall of the ink chamber 29 to bend further to thereby apply a pressure to ink in the ink chamber 29. At this time, the original signal ODRV that includes pulses having crests and troughs that are inverted from the reference pulses P1 to P4 included in the original signal ODRVa at the time of normal printing shown in FIG. 3 and the reference pulses P1 to P4 included in the original signal ODRVb at the time of nozzle testing shown in FIG. 4 may be used as the original signal ODRVa at the time of normal printing and the original signal ODRVb at the time of nozzle testing. That is, the original signal ODRVa at the time of normal printing may employ a signal that includes four reference pulses P, each of which changes from an intermediate voltage to a decompression voltage that is lower than the intermediate voltage, changes to a pressurization voltage that is higher than the intermediate voltage and then changes to the intermediate voltage, three solidification prevention pulses PP, each of which changes from the intermediate voltage to a prevention voltage that is lower than the intermediate voltage and then changes to the intermediate voltage, and a margin M, and the original signal ODRVb at the time of nozzle testing may employ a signal that includes four reference pulses P, each of which changes from the intermediate voltage to the decompression voltage that is lower than the intermediate voltage, changes to the pressurization voltage that is higher than the intermediate voltage and then changes to the intermediate voltage, and one solidification prevention pulse, which changes from the intermediate voltage to the prevention voltage that is lower than the intermediate voltage and then changes to the intermediate voltage, and does not include a margin M.

In the above described embodiment, in the nozzle testing routine shown in FIG. 7, nozzle testing is performed in such a manner that the print head 24 is negatively charged, the ink receiving area 52 is positively charged, ink is then discharged and a voltage change at that time is detected by the voltage detection circuit 54. Instead, it is applicable that the electrode member 57 and the print head 24 are electrically connected through a direct-current power supply and a resistance element using the voltage applying circuit 53 so that the electrode member 57 is a negative electrode and the print head 24 is a positive electrode, the voltage detection circuit 54 is connected to detect a voltage of the print head 24, the CPU 72 executes processes in accordance with the above described nozzle testing routine and then tests on the basis of the detected voltage change whether ink is discharged from the nozzle. In this case as well, it is possible to effectively obtain a further large detection signal when it is tested whether ink is able to be discharged from the nozzles.

In the above described embodiment, the nozzle testing routine is executed when there are any print queue data in step S110 in the main routine; however, the nozzle testing routine may be, for example, executed every time the number of movements of the carriage 22 reaches a predetermined number (for example, every 100 paths, or the like), may be executed at predetermined intervals (for example, every day, every week, or the like), or may be executed in accordance with instructions received from the user through operating an operation panel (not shown). In addition, the nozzle testing routine may be executed when the ink jet printer 20 is tested before shipment.

In the above described embodiment, a mechanism that discharges ink using the piezoelectric elements 48 is employed; however a mechanism that discharges ink is not limited to this mechanism. For example, a mechanism that conducts an electric current to a heater to discharge ink using generated bubbles may be employed. In this case as well, it is possible to effectively obtain a further large detection signal when it is tested whether ink is able to be discharged from the nozzles.

In the above described embodiment, the print head 24 is moved in the main scanning direction by the carriage belt 32 and the carriage motor 34*a* to perform printing; however, the aspects of the invention may be applied to the one in which the print head 24 is not moved in the main scanning direction. Specifically, a print head (so-called line ink jet head, which is, for example, described in JP-A-2002-200779) provides nozzle arrays of colors that are arrayed in the main scanning direction perpendicular to the transport direction of the recording sheet S with the length equal to or larger than the width of the recording sheet S, and the print head may be applied to discharge ink onto the recording sheet S. At this time, the ink receiving area 52 of the nozzle test device 50 is formed to have a size by which ink discharged from the nozzle arrays 43 of colors is able to be received. In this case as well, it is possible to effectively obtain a further large detection signal when it is tested whether ink is able to be discharged from the nozzles.

In the above described embodiment, the head driving waveform generating circuit 60 generates, as the original signal ODRVb at the time of nozzle testing, a signal that includes a reference pulse group GP1*b*, which includes one solidification prevention pulse PP and a plurality of reference pulse groups GP similar to the reference pulse group GP1*b*; however, the head driving waveform generating circuit 60 may generate, as the original signal ODRVb, a signal that includes a reference pulse group GP, which does not include any solidification prevention pulses PP, and a plurality of reference pulse groups GP similar to the reference pulse group GP. In this case, for example, flushing may be periodically performed, or nozzle testing may be additionally performed during the flushing.

In the above described embodiment, the liquid discharging apparatus is exemplified as the ink jet printer 20; however, the liquid discharging apparatus may be exemplified as a printer that discharges a liquid body (fluid dispersion) in which liquid or particles of functional material, other than ink, are dispersed or a flowage body such as gel or may be exemplified as a printer that discharges solid that may be discharged as a fluid. For example, the aspects of the invention may be embodied as a liquid discharging apparatus, which discharges liquid that dissolves materials, such as electrode materials or color materials, used for manufacturing a liquid crystal display, an electroluminescence (EL) display, a field emission display and a color filter, or the like, a liquid body discharging apparatus, which discharges liquid body in which the above materials are dispersed or a liquid discharging apparatus, which discharges liquid as a sample, used as a precision pipette. Furthermore, the liquid discharging apparatus may be a liquid discharging apparatus that discharges a transparent resin liquid, such as an ultraviolet curing resin, for forming a microscopic semi-spherical lens (optical lens) used for an optical communication element, or the like, on a substrate, or a flowage discharging apparatus that discharges a gel.

What is claimed is:

1. A liquid discharging apparatus comprising:

a discharging device that is able to discharge liquid from a nozzle to a target on the basis of discharge data;

a liquid receiving device that receives liquid discharged from the nozzle;

a voltage applying device that applies a predetermined voltage between the discharging device and the liquid receiving device;

an electrical change detection device that detects at least one of an electrical change in the discharging device and an electrical change in the liquid receiving device;

a driving signal generating device that, at the time of discharging on the basis of the discharge data during a printing mode, generates a discharge data driving signal, which is a driving signal for the discharging device and which provides a predetermined interval between a plurality of reference driving waveforms, and that, at the time of predetermined nozzle testing during a testing mode, generates a test driving signal which is a driving signal for the discharging device and in which one or more intervals between the plurality of reference driving waveforms of the test driving signal are set to be shorter by a consistent, fixed amount than the predetermined interval between the plurality of reference driving waveforms of the driving signal of the printing mode; and a control device that causes the driving signal generating device to alternate between the printing mode and the testing mode, such that at the time of discharging on the basis of the discharge data, the control device controls the discharging device so as to perform discharging in the printing mode on the basis of the discharge data using the generated discharge data driving signal, and that, at the time of the nozzle testing, controls the voltage applying device so as to apply the predetermined voltage between the discharging device and the liquid receiving device in the testing mode, and that controls the discharging device using the generated test driving signal so as to discharge a plurality of droplets of the liquid from the nozzle to determine on the basis of the detected electrical change whether liquid is discharged from the nozzle during the testing mode.

2. The liquid discharging apparatus according to claim 1, wherein the driving signal generating device generates, as the discharge data driving signal, a signal that includes a plurality of reference driving waveform groups, each of which includes a predetermined number of the reference driving waveforms, and generates, as the test driving signal, a signal that includes a plurality of reference driving waveform groups, each of which includes the predetermined number of the reference driving waveforms and in which one or more intervals between the plurality of reference driving waveform groups are set to be shorter than the predetermined interval in such a manner that an interval between the reference driving waveform groups is set to be shorter than that of the discharge data driving signal.

3. The liquid discharging apparatus according to claim 2, further comprising:

a transport device that reciprocally moves the discharging device at the time of discharging on the basis of the discharge data, wherein the driving signal generating device generates, as the discharge data driving signal, a signal that includes a temporal margin required for positioning the transport device in an interval between the reference driving waveform groups, and generates, as the test driving signal, a signal that shortens the interval between the reference driving waveform groups without including the margin as compared with that of the discharge data driving signal.

4. The liquid discharging apparatus according to claim 1, wherein the driving signal generating device generates, as the discharge data driving signal, a signal that includes a micro-oscillation waveform between a plurality of the reference driving waveforms used for discharging liquid, and generates, as the test driving signal, a signal in which one or more of the micro-oscillation waveforms are omitted from the discharge data driving signal to shorten an interval between the one or more reference driving waveforms as compared with the predetermined interval.

5. The liquid discharging apparatus according to claim 1, wherein the driving signal generating device generates, as the discharge data driving signal, a signal that includes a micro-oscillation waveform between a plurality of the reference driving waveforms used for discharging liquid, and generates, as the test driving signal, a signal in which one or more micro-oscillation waveforms shorter than that of the discharge data driving signal are included to thereby shorten an interval between the one or more reference driving waveforms as compared with the predetermined interval.

6. A method of controlling a liquid discharging apparatus, that includes a discharging device that is able to discharge liquid from a nozzle to a target and a liquid receiving device that receives liquid discharged from the nozzle, the method comprising:

at the time of discharging on the basis of discharge data in a printing mode, generating a discharge data driving signal, which is a driving signal for the discharging device and which provides a predetermined interval between a plurality of reference driving waveforms;

at the time of predetermined nozzle testing during a testing mode, generating a test driving signal, which is a driving signal for the discharging device and in which one or more intervals between the plurality of reference driving waveforms of the test driving signal are set to be shorter by a consistent, fixed amount than the predetermined interval between the plurality of reference driving waveforms of the driving signal of the printing mode;

alternating between the printing mode and the testing mode;

at the time of discharging on the basis of the discharge data during print mode, controlling the discharging device so as to perform the discharging using the generated discharge data driving signal; and at the time of the nozzle testing in nozzle testing mode, applying a predetermined voltage between the discharging device and the liquid receiving device and controlling the discharging device using the generated test driving signal so as to discharge a plurality of droplets of the liquid from the nozzle to determine on the basis of at least one of an electrical change in the discharging device and an electrical change in the liquid receiving device whether liquid is discharged from the nozzle.

7. A computer readable recording medium storing a program, executable on one or plurality of computers, comprising instructions for implementing the method according to claim 6.

8. The liquid discharging apparatus according to claim 1, wherein the plurality of reference driving waveforms of the test driving signal are the same waveforms as the plurality of reference driving waveforms of the driving signal of the printing mode.

* * * * *